US007459041B2

(12) United States Patent
Beguinot et al.

(10) Patent No.: US 7,459,041 B2
(45) Date of Patent: Dec. 2, 2008

(54) METHOD FOR MAKING AN ABRASION-RESISTANT STEEL PLATE

(75) Inventors: Jean Beguinot, Le Creusot (FR); Jean-Georges Brisson, Le Creusot (FR)

(73) Assignee: Industeel Creusot, Puteaux (FR)

( * ) Notice: Subject to any disclaimer, the term of this patent is extended or adjusted under 35 U.S.C. 154(b) by 339 days.

(21) Appl. No.: 10/535,418

(22) PCT Filed: Nov. 13, 2003

(86) PCT No.: PCT/FR03/03359

§ 371 (c)(1),
(2), (4) Date: Feb. 13, 2006

(87) PCT Pub. No.: WO2004/048620

PCT Pub. Date: Jun. 10, 2004

(65) Prior Publication Data

US 2006/0137780 A1 Jun. 29, 2006

(30) Foreign Application Priority Data

Nov. 19, 2002 (FR) ..... 02 14424

(51) Int. Cl.
*C21D 8/02* (2006.01)
*C21D 9/00* (2006.01)

(52) U.S. Cl. ..... 148/664; 148/547; 148/548; 148/654; 148/660; 148/661

(58) Field of Classification Search ..... 148/320, 148/330, 333–336, 547, 548, 654, 660, 661, 148/664; 420/104–111, 112–124
See application file for complete search history.

(56) References Cited

U.S. PATENT DOCUMENTS 4,459,162 A * 7/1984 Norstrom et al. ..... 420/106
5,108,518 A 4/1992 Fukui et al.
5,393,358 A 2/1995 Shikanai et al.
5,645,794 A * 7/1997 Beguinot et al. ..... 420/106
5,695,576 A * 12/1997 Beguinot ..... 148/328
5,714,116 A * 2/1998 Beguinot et al. ..... 420/105
6,080,247 A 6/2000 Arnett et al.
6,899,774 B2 * 5/2005 Takayama et al. ..... 148/336

FOREIGN PATENT DOCUMENTS

EP 0 527 276 A1 2/1993
JP 9-249935 A 9/1997
JP 10-324952 * 12/1998

OTHER PUBLICATIONS

Computer-generated English translation of Japanese patent 10-324952, Watari, Koji et al. Dec. 8, 1998.*

* cited by examiner

*Primary Examiner*—Deborah Yee
(74) *Attorney, Agent, or Firm*—Sughrue Mion, PLLC

(57) ABSTRACT

The invention concerns a method for making an abrasion resistant steel plate having a chemical composition comprising: 0.35%≦C≦0.8%, 0%≦Si≦2%; 0%≦AI≦2%; 0.35%≦Si+AI≦2%; 0%≦Mn≦2.5%; 0%≦Ni≦5%; 0%≦Cr≦5%; 0%≦Mo≦0.050; 0%≦W≦1%; 0,1%≦Mo+W/2≦0.5%; 0%≦B≦0.02%; 0%≦Ti≦2%; 0%≦Zr≦4%; 0.05%≦Ti+Zr/2≦2%; 0%≦S≦0.15%; N≦0,03; optionally 0% to 1.5% of Cu; optionally Nb, Ta or V with Nb/2+Ta/4 +V≦0.5%; optionally less than 0.1% of Se, Te, Ca, Bi or Pb; the rest being iron and impurities; the composition satisfying: 0.1 %<C*=C−Ti/4−Zr/8+7×N/8≦0.55% and 1.05×Mn+0.54×Ni+0.5O×Cr+0.3×$(Mo+W/2)^{1/2}$+K>1.8, with K=0.5 if B ≧0.0005% and K=0 if B<0.0005% and Ti+Zr/2−7×N/2≧0.05%; hardening after austenitization while cooling at a speed >0.5 ° C./s between a temperature >$AC_3$ and ranging between T=800−270×C*−9O×Mn−37×Ni−70×Cr−83×(Mo+W/2) and T−50° C.; then at a core speed Vr<1150×$ep^{-1.7}$ between T and 100° C., (ep=plate thickness in mm); cooling down to room temperature. The invention also concerns the resulting plate.

12 Claims, No Drawings

METHOD FOR MAKING AN ABRASION-RESISTANT STEEL PLATE

The present invention relates to an abrasion-resistant steel and its production method.

Abrasion-resistant steels are well known and are generally steels having great hardness (of from 400 to 500 Brinell), having a martensitic structure and containing from 0.12% to 0.3% of carbon. It is generally taken that, in order to increase the wear-resistance, it is simply necessary to increase the hardness, but that is done to the detriment of other properties, such as, for example, suitability for welding or forming by bending. In order to obtain steels having both very good wear-resistance and good suitability for use, therefore, means other than increasing the hardness have been sought.

Thus, it has been proposed in EP 0527 276 and U.S. Pat. No. 5,393,358 to improve the abrasion-resistance of a steel which contains from 0.05% to 0.45% of carbon, up to 1% of silicon, up to 2% of manganese, up to 2% of copper, up to 10% of nickel, up to 3% of chromium and up to 3% of molybdenum, boron, niobium and vanadium, by adding from 0.015% to 1.5% of titanium, in order to form coarse titanium carbides. That steel is quenched and consequently comprises a martensitic structure, the increase in abrasion-resistance being obtained by the presence of coarse titanium carbides. However, more particularly when the steel is cast in bars, that improvement is limited because, under the effect of abrasive stresses, the carbides become separated and no longer serve their purpose. Furthermore, in those steels, the presence of coarse titanium carbides inhibits ductility. Consequently, plates produced with those steels are difficult to planish and bend, which limits their possible uses.

The object of the present invention is to overcome those disadvantages by providing an abrasion-resistant steel plate which has good surface evenness and which, all things otherwise being equal, has abrasion-resistance which is better than that of known steels.

To that end, the invention relates to a method for producing a workpiece, and in particular a plate, of steel for abrasion, whose chemical composition comprises by weight:

$$0.35\% \leqq C \leqq 0.8\%$$

$$0\% \leqq Si \leqq 2\%$$

$$0\% \leqq Al \leqq 2\%$$

$$0.35\% \leqq Si+Al \leqq 2\%$$

$$0\% \leqq Mn \leqq 2.5\%$$

$$0\% \leqq Ni \leqq 5\%$$

$$0\% \leqq Cr \leqq 5\%$$

$$0\% \leqq Mo \leqq 0.50\%$$

$$0\% \leqq W \leqq 1.00\%$$

$$0.1\% \leqq Mo+W/2 \leqq 0.50\%$$

$$0\% \leqq Cu \leqq 1.5\%$$

$$0\% \leqq B \leqq 0.02\%$$

$$0\% \leqq Ti \leqq 2\%$$

$$0\% \leqq Zr \leqq 4\%$$

$$0.05\% \leqq Ti+Zr/2 \leqq 2\%$$

$$0\% \leqq S \leqq 0.15\%$$

$$N \leqq 0.03\%$$

optionally at least one element selected from Nb, Ta and V at contents such that $Nb/2+Ta/4+V \leqq 0.5\%$, optionally at least one element from Se, Te, Ca, Bi, Pb at contents which are less than or equal to 0.1%, the balance being iron and impurities resulting from the production operation, the chemical composition further complying with the following relationships, with $C^*=C-Ti/4-Zr/8+7\times N/8$:

$$0.10\% \leqq C^* \leqq 0.55\%$$

and:

$$Ti+Zr/2-7\times N/2 \geqq 0.05\%$$

and:

$$1.05\times Mn+0.54\times Ni+0.50\times Cr+0.3\times(Mo+W/2)^{1/2}+K>1.8, \text{ or more advantageously } 2$$

with: $K=0.5$ if $B \geqq 0.0005\%$ and $K=0$ if $B<0.0005\%$;

according to the method, the workpiece or the plate is subjected to a thermal quenching processing operation which is carried out in the heat for forming in the hot state, such as rolling or after austenitization by reheating in a furnace, which consists in:

cooling the plate at a mean cooling rate greater than 0.5° C./s between a temperature greater than $AC_3$ and a temperature of from $T=800-270\times C^*-90\times Mn-37\times Ni\times 70\times Cr-83\times(Mo+W/2)$ to T−50° C., the temperature being expressed in ° C. and the contents of C*, Mn, Ni, Cr, Mo and W being expressed as % by weight, then cooling the plate at a mean core cooling rate $Vr<1150\times ep^{-1.7}$ (in ° C./s) and greater than 0.1° C./s between the temperature T and 100° C., ep being the thickness of the plate expressed in mm, and cooling the plate as far as ambient temperature, planishing optionally being carried out.

Quenching may optionally be followed by tempering at a temperature of less than 350° C., and preferably less than 250° C.

The invention also relates to a workpiece, and in particular a plate, obtained in particular by this method, the steel having a structure which is constituted by from 5% to 20% of retained austenite, the remainder of the structure being martensitic or martensitic/bainitic with carbides. When the workpiece is a plate, its thickness may be from 2 mm to 150 mm and its surface evenness may be characterized by a deflection which is less than or equal to 12 mm/m, and preferably less than 5 mm/m.

When the carbon content is such that:

$$0.1\% \leqq C-Ti/4-Zr/8+7\times N/8 \leqq 0.2\%,$$

the hardness is preferably from 280 HB to 450 HB.

When the carbon content is such that:

$$0.2\% < C-Ti/4-Zr/8+7\times N/8 \leqq 0.3\%,$$

the hardness is preferably from 380 HB to 550 HB.

When the carbon content is such that:

$$0.3\% < C-Ti/4-Zr/8+7\times N/8 \leqq 0.5\%,$$

the hardness is preferably from 450 HB to 650 HB.

The invention will now be described in greater detail, but in a non-limiting manner, and illustrated with reference to examples.

In order to produce a plate according to the invention, a steel is produced whose chemical composition comprises, in % by weight:

from 0.35% to 0.8% of carbon, and preferably more than 0.45%, or more than 0.5%, and from 0% to 2% of titanium, from 0% to 4% of zirconium, these contents having to be such that: $0.05\% \leqq Ti+Zr/2 \leqq 2\%$. The carbon is intended, firstly, to achieve a sufficiently hard martensitic structure and, secondly, to form titanium and/or zirconium carbides. The total Ti+Zr/2 must be greater than 0.05%, preferably greater than 0.10%, and, more advantageously still, greater than 0.3%, or even greater than 0.5%, so that there is a minimum of carbides formed, but must remain less than 2%, and preferably less than or equal to 0.9%, because above that level the toughness and the suitability for use are inhibited.

From 0% (or trace levels) to 2% of silicon and from 0% (or trace levels) to 2% of aluminium, the total Si+Al being from 0.35% to 2% and preferably being greater than 0.5%, and more advantageously still greater than 0.7%. Those elements, which are deoxidants, further have the effect of promoting the production of a metastable retained austenite which is heavily charged with carbon and whose transformation into martensite is accompanied by a large expansion promoting the anchoring of the titanium carbides.

From 0% (or trace levels) to 2% or even 2.5% of manganese, from 0% (or trace levels) to 4% or even 5% of nickel and from 0% (or trace levels) to 4% or even 5% of chromium, in order to obtain an adequate level of quenchability and to adjust the various mechanical characteristics or characteristics of use. Nickel has in particular an advantageous effect on the toughness, but that element is expensive. Chromium also forms fine carbides in martensite or bainite.

From 0% (or trace levels) to 0.50% of molybdenum. That element increases the quenchability and forms, in martensite or bainite, fine hardening carbides, in particular by precipitation owing to auto-tempering during cooling. It is not necessary to exceed a content of 0.50% in order to obtain the desired effect, in particular with regard to the precipitation of hardening carbides. Molybdenum can be replaced, completely or partially, with twice the weight of tungsten. Nevertheless, this substitution is not desirable in practice because it does not provide any advantage over molybdenum and is more expensive.

Optionally, from 0% to 1.5% of copper. That element can bring about an additional hardening without inhibiting the weldability. Above a level of 1.5%, it no longer has any significant effect, leads to hot-rolling difficulties and is needlessly expensive.

From 0% to 0.02% of boron. That element can be added optionally in order to increase the quenchability. So that that effect is obtained, the content of boron must preferably be greater than 0.0005%, or more advantageously 0.001%, and does not need to exceed substantially 0.01%.

Up to 0.15% of sulphur. That element is a residue which is generally limited to 0.005% or less, but its content may be voluntarily increased in order to improve machinability. It should be noted that, in the presence of sulphur, in order to prevent difficulties concerning transformation in the hot state, the content of manganese must be greater than 7 times the content of sulphur.

Optionally, at least one element selected from niobium, tantalum and vanadium at contents such that Nb/2+Ta/4+V remains less than 0.5% in order to form relatively coarse carbides which improve the resistance to abrasion. However, the carbides formed by those elements are less effective than those formed by titanium or zirconium and, for that reason, they are optional and added in a limited quantity.

Optionally, one or more elements selected from selenium, tellurium, calcium, bismuth and lead at contents of less than 0.1% each. Those elements are intended to improve machinability. It should be noted that, when steel contains Se and/or Te, the content of manganese must be such, taking into consideration the content of sulphur, that manganese selenides or tellurides can form.

The balance being iron and impurities resulting from the production operation. The impurities include in particular nitrogen whose content depends on the production method, but generally does not exceed 0.03%. That element can react with titanium or zirconium to form nitrides which must not be too coarse in order not to inhibit the toughness. In order to prevent the formation of coarse nitrides, titanium and zirconium may be added to the liquid steel in a very progressive manner, for example, by placing in contact with the oxidized liquid steel an oxidized phase, such as a slag charged with titanium or zirconium oxides, then deoxidizing the liquid steel in order to cause the titanium or zirconium to diffuse slowly from the oxidized phase to the liquid steel.

Furthermore, in order to obtain satisfactory properties, the contents of carbon, titanium, zirconium and nitrogen must be such that:

$$0.1\% \leqq C-Ti/4-Zr/8+7\times N/8 \leqq 0.55\%.$$

The expression $C-Ti/4-Zr/8+7\times N/8=C^*$ represents the content of free carbon after precipitation of the titanium and zirconium carbides, taking into consideration the formation of titanium and zirconium nitrides. That free carbon content C* must be greater than 0.1%, and preferably greater than or equal to 0.22%, in order to have martensite having a minimum hardness, but above 0.55% the toughness and suitability for use are excessively inhibited.

The chemical composition must further be selected so that the quenchability of the steel is sufficient, taking into consideration the thickness of the plate which it is desirable to produce. To that end, the chemical composition must comply with the following relationship:

$$Quench=1.05\times Mn+0.54\times Ni+0.50\times Cr+0.3\times(Mo+W/2)^{1/2}+K>1.8 \text{ or more advantageously } 2$$

with: K=0.5 if B>or equal to 0.0005% and K=0 if B<0.0005%.

It should be noted that, more particularly when Quench is from 1.8 to 2, it is preferable for the content of silicon to be greater than 0.5% in order to promote the formation of retained austenite.

Furthermore, the contents of Ti, Zr and N must preferably be such that: $Ti+Zr/2-7\times N/2 \geqq 0.05\%$ and more advantageously greater than 0.1%, and even more advantageously greater than 0.3%, so that the content of carbides is sufficient.

Finally and in order to obtain good abrasion resistance, the micrographic structure of the steel is constituted by martensite or bainite or an admixture of those two structures and from 5% to 20% of retained austenite, that structure further comprising coarse titanium or zirconium carbides, or niobium, tantalum or vanadium carbides, which are formed at high temperature. The inventors have established that the effectiveness of coarse carbides for improving abrasion resistance could be inhibited by the premature separation thereof and that that separation could be prevented by the presence of metastable austenite which is transformed into new martensite under the effect of the abrasion phenomena. Since the transformation of the metastable austenite into new martensite is brought about by expansion, that transformation in the abraded sub-layer increases the resistance to separation of the carbides and, in that manner, improves the abrasion resistance.

Furthermore, the great hardness of the steel and the presence of embrittling titanium carbides make it necessary to limit insofar as possible the planishing operations. From that point of view, the inventors established that, by slowing down the cooling sufficiently in the region of bainitic/martensitic transformation, the residual deformations of the products are reduced, which allows planishing operations to be limited. The inventors established that, by cooling down the workpiece or the plate at a cooling rate $Vr<1150\times ep^{-1.7}$ (in this formula, ep is the thickness of the plate expressed in mm and the cooling rate is expressed in ° C/s), below a temperature $T=800-270\times C^*-90\times Mn-37\times Ni-70\times Cr-83\times(Mo+W/2)$, (expressed in ° C.), firstly, the production of a significant proportion of residual austenite was promoted and, secondly, the residual stresses brought about by the phase changes were reduced.

In order to produce a very planar plate which has good abrasion resistance, the steel is produced and cast in the form of a slab or bar. The slab or bar is hot-rolled in order to obtain a plate which is subjected to thermal processing which allows both the desired structure and good surface evenness to be obtained without further planishing or with limited planishing. The thermal processing may be carried out directly in the rolling heat or carried out subsequently, optionally after cold-planishing or planishing at a medium temperature.

In order to carry out the thermal processing operation:

the steel is heated above the $AC_3$ point in order to confer on it a completely austenitic structure, then, it is cooled at a mean cooling rate greater than the critical bainitic transformation rate as far as a temperature which is equal to or slightly less than (by more than approximately 50° C.) a temperature $T=800-270\times C^*-90\times Mn-37\times Ni-70\times Cr-83\times(Mo+W/2)$ (expressed in ° C.), then, the plate is cooled, between the temperature defined in this manner (that is to say, approximately from T to T−50° C.) and approximately 100° C., at a mean core cooling rate Vr of from 0.1° C./s, in order to obtain sufficient hardness, to $1150\times ep^{-1.7}$, in order to obtain the desired structure, and the plate is cooled as far as ambient temperature, preferably but without being compulsory, at a slow rate.

Furthermore, it is possible to carry out a stress-relief processing operation at a temperature less than or equal to 350° C., and preferably less than or equal to 250° C.

In this manner, a plate is obtained whose thickness can be from 2 mm to 150 mm and which has excellent surface evenness, characterized by a deflection which is less than 12 mm per metre without planishing or with moderate planishing. The plate has a hardness of from 280 HB to 650 HB. That hardness depends principally on the content of free carbon $C^*=C-Ti/4-Zr/8+7\times N/8$.

In accordance with the contents of free carbon C*, it is possible to define a plurality of ranges corresponding to levels of increasing hardness, and in particular:

a) $0.1\% \leqq C^* \leqq 0.2\%$, the hardness is approximately from 280 HB to 450 HB, b) $0.2\% \leqq C^* \leqq 0.3\%$, the hardness is approximately from 380 HB to 550 HB, c) $0.3\% \leqq C^* \leqq 0.5\%$, the hardness is approximately from 450 HB to 650 HB.

Since the hardness is a function of the content of free carbon C*, the same hardness can be obtained with very different contents of titanium or zirconium. With equal hardness, the abrasion resistance becomes higher as the content of titanium or zirconium becomes greater. Similarly, with an equal content of titanium or zirconium, the abrasion resistance improves as the hardness becomes greater. Furthermore, using the steel becomes easier as the content of free carbon decreases, but with an equal content of free carbon, the ductility improves as the content of titanium decreases. All those considerations allow the contents of carbon and titanium or zirconium to be selected that lead to all the properties which are most suitable for each field of application.

According to the hardness levels, the uses are, for example:

from 280 to 450 HB: scoops, skips for lorries and dump trucks, cyclone shielding, hoppers, moulds for aggregates, from 380 to 550 HB: shielding for impact grinders, bulldozer blades, grab bucket blades, grills for sieves, from 450 to 650 HB: plates for shielding cylinder type grinders, reinforcement elements for scoops, reinforcement elements under leading blades, cut-water blade shields, leading edges.

By way of example, steel plates designated A to G according to the invention and H to J according to the prior art are considered. The chemical compositions of the steels, expressed in $10^{-3}$% by weight, as well as the hardness, the content of residual austenite of the structure and a wear resistance value Rus are summarized in Table 1.

TABLE 1

| | C | Si | Al | Mn | Ni | Cr | Mo | W | Ti | B | N | HB | % aust | Rus |
|---|---|---|---|---|---|---|---|---|---|---|---|---|---|---|
| A | 360 | 850 | 50 | 1300 | 500 | 700 | 100 | 500 | 400 | 2 | 6 | 460 | 10 | 1.42 |
| B | 640 | 850 | 50 | 400 | 1500 | 700 | 110 | 450 | 620 | 3 | 7 | 555 | 14 | 2.72 |
| C | 590 | 520 | 570 | 550 | 320 | 1850 | 470 | — | 540 | — | 7 | 570 | 12 | 2.24 |
| D | 705 | 460 | 630 | 1090 | 280 | 2450 | 430 | 100 | 825 | — | 7 | 580 | 13 | 3.14 |
| E | 690 | 370 | 25 | 740 | 310 | 2100 | 460 | — | 795 | — | 6 | 605 | 10 | 2.83 |
| F | 350 | 810 | 30 | 1200 | 270 | 1350 | 380 | | 160 | 2 | 6 | 510 | 8 | 1.32 |
| G | 390 | 790 | 35 | 1210 | 250 | 1340 | 390 | | 405 | 3 | 6 | 495 | 11 | 1.77 |
| H | 340 | 380 | 30 | 1260 | 470 | 820 | 370 | — | 410 | 3 | 6 | 475 | 1 | 0.86 |
| I | 315 | 330 | 25 | 1230 | 180 | 1360 | 395 | | 165 | 2 | 6 | 515 | 2 | 0.7 |
| J | 367 | 315 | 30 | 1215 | 210 | 1375 | 405 | | 430 | 2 | 5 | 500 | 2 | 1.01 |

The wear resistance value Rus varies as the inverse logarithm of the loss of weight of a prismatic test piece which is rotated in a container containing graded quartzite aggregate.

All the plates have a thickness of 30 mm and the plates corresponding to steels A to G have been quenched in accordance with the invention, after austenitization at 900° C.

After austenitization, the cooling conditions are:

for the plates of steel B and D: cooling at a mean rate of 0.7° C./s above temperature T defined above and at a mean rate of 0.13° C./s therebelow, in accordance with the invention;

for plates of steel A, C, E, F, G: cooling at a mean rate of 6° C./s above temperature T defined above and at a mean rate of 1.4° C./s therebelow, in accordance with the invention;

for the plates of steel H, I, J, given by way of comparison: austenitization at 900° C., followed by cooling at a mean rate of 20° C./s above temperature T defined above, and at a mean rate of 12° C./s therebelow.

The plates according to the invention have a martensitic/bainitic structure which contains from 5% to 20% of retained austenite, whereas the plates given by way of comparison have a completely martensitic structure, that is to say, martensitic and not containing more than 2 or 3% of retained austenite. All the plates contain carbides.

A comparison of the wear resistances shows that, with a similar hardness and content of titanium, the plates according to the invention have a coefficient Rus which is on average 0.5 greater than that of the plates according to the prior art. In particular, comparison of examples A and H which substantially differ in terms of the structure (content of residual austenite of 10% for A, completely martensitic structure for H) shows the incidence of the presence of residual austenite in the structure. It should be noted that the difference in content of residual austenite results from both the difference between the thermal processing operations and the difference between the contents of silicon.

It can further be observed that, all things substantially being equal otherwise, the contribution to the wear resistance which can be attributed to the titanium carbides is significantly higher when their presence is combined with that of residual austenite in accordance with the invention than when those carbides are precipitated within a matrix which is substantially free from residual austenite. Thus, for similar differences in the contents of titanium (and therefore of TiC, the carbon still being in excess), the pair of steels F,G (according to the invention) differ distinctly from the pair of steels I,J in terms of increase in resistance brought about by the titanium. For F,G, the increase in resistance Rus brought about by 0.245% of Ti is 0.46, whereas it is only 0.31 for a difference of 0.265% of Ti in the case of the pair I,J.

That observation can be attributed to the increased squeezing effect on the titanium carbides by the surrounding matrix when it contains residual austenite which can be transformed into hard martensite with expansion under the effect of the abrasive stresses.

Furthermore, the deformation after cooling, without planishing, for the steel plates according to the invention is less than 10 mm/m and is approximately 15 mm/m for the steel plate H.

In practice, that leads either to the possibility of supplying the products without planishing, or carrying out planishing in order to comply with stricter requirements in terms of surface evenness (for example, 5 mm/m), but which is carried out more readily and with fewer stresses being introduced owing to the lesser original deformation of the products according to the invention.

The invention claimed is:

1. Method for producing a workpiece of steel which is resistant to abrasion and whose chemical composition comprises, by weight:

$$0.35\% \leqq C \leqq 0.8\%$$

$$0\% \leqq Si \leqq 2\%$$

$$0\% \leqq Al \leqq 2\%$$

$$0.35\% \leqq Si+Al \leqq 2\%$$

$$0\% \leqq Mn \leqq 2.5\%$$

$$0\% \leqq Ni \leqq 5\%$$

$$0\% \leqq Cr \leqq 5\%$$

$$0\% \leqq Mo \leqq 0.50\%$$

$$0\% \leqq W \leqq 1.00\%$$

$$0.1\% \leqq Mo+W/2 \leqq 0.50\%$$

$$0\% \leqq B \leqq 0.02\%$$

$$0\% \leqq Ti \leqq 2\%$$

$$0\% \leqq Zr \leqq 4\%$$

$$0.05\% \leqq Ti+Zr/2 \leqq 2\%$$

$$0\% \leqq S \leqq 0.15\%$$

$$N<0.03\%$$

optionally from 0% to 1.5% of copper, optionally at least one element selected from Nb, Ta and V at contents such that $Nb/2+Ta/4+V \leqq 0.5\%$, optionally at least one element selected from Se, Te, Ca, Bi, Pb at contents which are less than or equal to 0.1%, the balance being iron and impurities resulting from the production operation, the chemical composition further complying with the following relationships:

$$0.1\% \leqq C-Ti/4-Zr/8+7\times N/8 \leqq 0.55\%$$

and:

$$Ti+Zr/2-7\times N/2 \geqq 0.05\%$$

and:

$$1.05\times Mn+0.54\times Ni+0.50\times Cr+0.3\times(Mo+W/2)^{1/2}+K>1.8$$

with K=0.5 if $B \geqq 0.0005\%$ and K=0 if $B<0.0005\%$, according to which the workpiece is subjected to a thermal quenching processing operation which is carried out in the heat for forming in the hot state, or after austenitization by reheating in a furnace in order to carry out the quenching, the process comprising:

cooling the workpiece at a mean cooling rate greater than 0.5° C./s between a temperature greater than $AC_3$ and a temperature of from $T=800-270\times C^*-90\times Mn-37\times Ni-70\times Cr-83\times(Mo+W/2)$, with $C^*=C-Ti/4-Zr/8+7\times N/8$, to T−50° C., then cooling the workpiece at a core cooling rate $Vr<1150\times ep^{-1.7}$ and greater than 0.1° C./s between the temperature T and 100° C., ep being the thickness of the plate expressed in mm, cooling the workpiece as far as ambient temperature.

2. Method according to claim 1, wherein:

$1.05\times Mn+0.54\times Ni+0.50\times Cr+0.3\times(Mo+W/2)^{1/2}+K>2$.

3. Method according to claim 1, wherein:

$C>0.45\%$.

4. Method according to claim 1, wherein:

$Si+Al>0.5\%$.

5. Method according to claim 1, wherein:

$Ti+Zr/2>0.10\%$.

6. Method according to claim 1, wherein:

$Ti+Zr/2>0.30\%$.

7. Method according to claim 1, wherein:

$C^*\geqq 0.22\%$.

8. Method according to claim 1, wherein tempering is further carried out at a temperature which is less than or equal to 350° C.

9. Method according to claims 1, wherein, in order to add titanium to the steel, the liquid steel is placed in contact with a slag containing titanium and the titanium of the slag is caused to diffuse slowly in the liquid steel.

10. Method according to claim 1, wherein the workpiece is a plate.

11. Method according to claim 1, wherein the heat for forming in the hot state is a rolling heat.

12. Method according to claim 1, further comprising carrying out planishing.

* * * * *